US006140968A

United States Patent [19]

Kawahata et al.

[11] Patent Number: 6,140,968

[45] Date of Patent: Oct. 31, 2000

[54] SURFACE MOUNT TYPE CIRCULARLY POLARIZED WAVE ANTENNA AND COMMUNICATION APPARATUS USING THE SAME

[75] Inventors: Kazunari Kawahata; Shigekazu Itoh, both of Kyoto; Yuichi Kushihi, Kanazawa; Masaru Shikata, Kanazawa; Haruo Matsumoto, Kanazawa, all of Japan

[73] Assignee: Murata Manufacturing Co., Ltd., Japan

[21] Appl. No.: 09/219,250

[22] Filed: Dec. 22, 1998

[30] Foreign Application Priority Data

Oct. 5, 1998 [JP] Japan ..... 10-282656
Nov. 16, 1998 [JP] Japan ..... 10-325028

[51] Int. Cl.[7] ..... H01Q 1/38

[52] U.S. Cl. ..... 343/700 MS; 343/702

[58] Field of Search ..... 343/700 MS, 702; H01Q 1/38

[56] References Cited

U.S. PATENT DOCUMENTS 5,717,407 2/1998 Hong ..... 343/700 MS 5,912,647 6/1999 Tsuru et al. ..... 343/700 MS

*Primary Examiner*—Michael C. Wimer

*Attorney, Agent, or Firm*—Ostrolenk, Faber, Gerb & Soffen, LLP

[57] ABSTRACT

A surface mount circularly polarized wave antenna which includes a substrate made of an insulating material and having a first main face, a second main face, and at least one side face extending between the first main face and second main face; a first ground electrode disposed on the first main face of the substrate; a radiation electrode disposed on the second main face; a feeding electrode having a strip shape and extending from the first main face of the substrate, on the one side face of the substrate, and toward the second main face, one edge of the feeding electrode being positioned near to one side of the radiation electrode; and a second ground electrode disposed on the one side face of the substrate where the feeding electrode is disposed, and electrically conductively isolated from the feeding electrode and electrically conductively connected to the first ground electrode; and a degeneracy separation element provided in relation to the radiation electrode for causing radiation of a circularly polarized wave from the radiation electrode.

12 Claims, 6 Drawing Sheets

SURFACE MOUNT TYPE CIRCULARLY POLARIZED WAVE ANTENNA AND COMMUNICATION APPARATUS USING THE SAME

BACKGROUND OF THE INVENTION

1. Field of the Invention

The present invention relates to a surface mount circularly polarized wave antenna and a communication apparatus using the same, and more particularly, to a surface mount circularly polarized wave antenna for use in a system using circularly polarized radio waves such as GPS, DAB, ETC, and the like, and a communication apparatus using the same.

2. Description of the Related Art

In recent years, there have been applied more different types of systems using circularly polarized radio waves such as GPS (Global Positioning System), DAB (Digital Audio Broadcasting), ETC (Electric Toll Collection), and the like. With the increase of such systems in number, it has been required more intensively to develop miniaturized antennas suitable for use in communication apparatuses of the systems and adapted to use with circularly polarized waves.

FIG. 10 shows one example of conventional circularly polarized wave antennas. The antenna of FIG. 10 is a square patch antenna. The circularly polarized wave antenna 1 shown in FIG. 10 comprises a ground electrode 3 disposed substantially on the whole of a first main face of a substrate 2 made of a dielectric and having a flat plate shape, a radiation electrode 4 having a substantially rectangular shape disposed on a second main face, and a feeding line 5 so provided as to go through the substrate 2 from the first main face to be connected to the radiation electrode 4. Six fixing electrodes 6 for soldering are disposed on side faces of the substrate 2. The fixing electrodes 6 are connected to the ground electrode 3. The feeding line 5 is insulated from the ground electrode 3 in the first main face of the substrate 2. The node between the radiation electrode 4 and the feeding line 5 is set at an appropriate position between the center of the radiation electrode 4 and one corner thereof. The radiation electrode 4 is so sized that each side of the electrode 4 has a length substantially equal to one half of the effective wavelength at a frequency applicable to the antenna. Furthermore, degeneracy separation elements 4a are provided in two diagonal opposite corners of the radiation electrode 4 (in this case, the elements are realized by forming a taper in the corners).

According to the circularly polarized wave antenna 1 configured as described above, a signal, input to the radiation electrode 4 through the feeding line 5, causes two resonant currents, which are perpendicular to each other and having a phase difference of 90°, to be generated in the radiation electrode 4. From the two resonant currents, a circularly polarized wave is radiated mainly in the normal direction of the radiation electrode 4.

However, the circularly polarized wave antenna 1 shown in FIG. 10 is so configured that the feeding line 5 goes through the substrate 2 from the first main face to the second main face. Therefore, there are problems that the surface mounting is difficult, and the mounting cost is increased.

SUMMARY OF THE INVENTION

Accordingly, it is a purpose of the present invention to solve the above-described problems and to provide a surface mount circularly polarized wave antenna of which the miniaturization and the surface mounting can be achieved, and a communication apparatus using the same.

According to a preferred embodiment of the present invention, there is provided a surface mount circularly polarized wave antenna which comprises a substrate made of an insulation material and having a first main face, a second main face, and at least one side face extending between the first and second main faces; a first ground electrode disposed on the first main face of the substrate; a radiation electrode having a substantially rectangular shape and disposed mainly on the second main face of the substrate; a feeding electrode having a strip shape and so disposed as to elongate from the first main face side of the substrate, on one side face of the substrate, and toward the second main face side, one edge of the feeding electrode being positioned near to one side of the radiation electrode; a second ground electrode disposed substantially on the whole of the side face of the substrate where the feeding electrode is formed, and in insulation from the feeding electrode and in connection to the first ground electrode; and a degeneracy separation means provided in relation to the radiation electrode.

According to the above-described surface mount circularly polarized wave antenna, the surface mounting can be easily achieved. In addition, the efficiency of the antenna can be enhanced. Furthermore, the miniaturization of the surface mount circularly polarized antenna can be attained.

In the above-described surface mount circularly polarized antenna, a degeneracy separation element as the degeneracy separation means may be provided in a corner of the radiation electrode.

In the above-described surface mount circularly polarized wave antenna, two second ground electrodes may be so disposed as to sandwich the feeding electrode and that the capacitance between one of the second ground electrodes and the radiation electrode is made different from that between the other of the second ground electrodes and the radiation electrode, whereby the second ground electrodes function as the degeneracy separation means.

The degeneracy separation means configured as described above can be made to radiate a circularly polarized wave instead of the degeneracy separation means.

In the above-described surface mount circularly polarized wave antenna, the feeding electrode may have at least one protuberance.

Owing to the above-described configuration, the capacitance between the feeding electrode and the radiation electrode can be increased, and the matching of input can be easily achieved.

In the above-described surface mount circularly polarized wave antenna, a third ground electrode may be formed substantially on the whole of at least one side face of the substrate excluding the side face thereof where the feeding electrode is formed, and in connection to the first ground electrode.

Owing to the above-described configuration, the surface mount circularly polarized wave antenna can be further miniaturized.

A part of the second and third ground electrodes may be so disposed as to extend onto the second main face of the substrate.

With the above-described configuration, the surface mount circularly polarized wave antenna can be more miniaturized.

In addition, according to an preferred embodiment of the present invention, there is provided a communication apparatus having the above-described surface mount circularly polarized wave antenna.

The communication apparatus can be miniaturized by employing the circularly polarized wave antenna of the present invention.

Other features and advantages of the present invention will be more apparent on consideration of the accompanying drawings and the following description.

DESCRIPTION OF THE PREFERRED EMBODIMENTS

Figure 1:
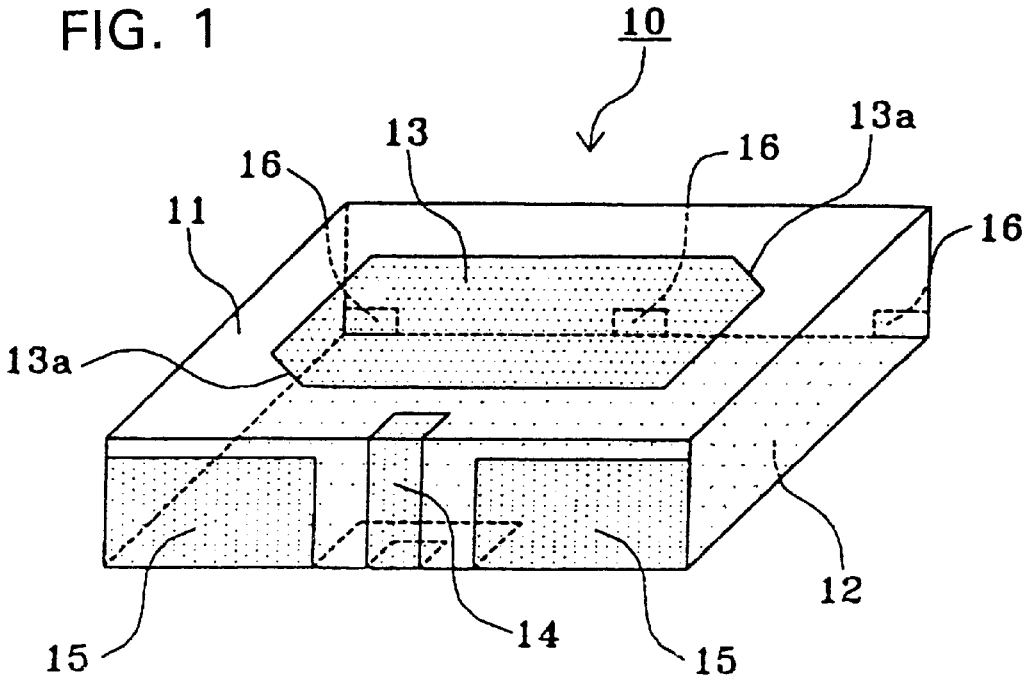
FIG. 1 is a perspective view of a surface mount circularly polarized wave antenna according to an embodiment of the present invention.

FIG. 1 shows a perspective view of a surface mount circularly polarized wave antenna according to an embodiment of the present invention. In a surface mount circularly polarized wave antenna 10 shown in FIG. 1, a first ground electrode 12 is disposed substantially on the whole of a first main face of a substrate 11 having a flat plate shape and made of a dielectric such as a ceramic, resin, and the like, while a radiation electrode 13 having a substantially rectangular shape is disposed on a second main face. A degeneracy separation element 13*a* as a degeneracy separation means is provided in two diagonal corners of the radiation electrode 13 (in this case, the element is realized by forming a taper in the corners). A feeding electrode 14 having a strip shape is disposed mainly on one side face of the substrate 11, elongating from the first main face toward the second main face side. One edge and the other edge of the feeding electrode 14 are so disposed as to be turned onto the second main face and the first main face of the substrate 11, respectively. The radiation electrode 13 is so provided that one side thereof is positioned near to the one edge of the feeding electrode 14. A second ground electrode 15 is disposed substantially on the whole of the side face of the substrate 11 where the feeding electrode 14 is disposed, and in connection to the ground electrode 12 and in insulation from the feeding electrode 14. Three fixing electrodes 16 for soldering are disposed on the side face of the substrate 11 opposite to the side face thereof where the feeding electrode 14 is disposed. The fixing electrodes 16 are connected to the first ground electrode 12.

According to the surface mount circularly polarized wave antenna 10 configured as described above, a signal, if it is input to the feeding electrode 14, is input to the radiation electrode 13 through the gap between the one edge of the feeding electrode 14 and the one side of the radiation electrode 13, due to the electromagnetic coupling produced between them. In the radiation electrode 13, the input signal causes two resonant currents to be generated, which are perpendicular to each other and have a phase difference of 90°, due to the degeneracy separation element 13. From the two resonant currents, a circularly polarized radio wave is radiated mainly in the normal direction of the radiation electrode 13.

According to the surface mount circularly polarized wave antenna 10 configured as described above, an electric current can be fed through the side face of the substrate 11. Therefore, the feeding line going through the substrate 11 becomes unnecessary, so that the surface mounting can be easily achieved.

In the side face of the substrate 11 where the feeding electrode 14 is disposed, the feeding electrode 14 is positioned near to the second ground electrode 15. Accordingly, a large part of an electric field starting from the feeding electrode 14 toward the ground electrodes (the first ground electrode 12, the second ground electrode 15, and ground electrodes provided on a substrate for the surface mount circularly polarized wave antenna 10 to be mounted) is directed concentrate toward the second ground electrode 15. Therefore, the leakage of the electric field which causes unnecessary radiation from the feeding electrode 14 is decreased, and thereby, the efficiency of the antenna can be enhanced.

The second ground electrode 15 is provided, that is, the ground electrode is positioned nearer to the radiation electrode 13, so that the capacitance between the radiation electrode 13 and the ground electrode (the first ground electrode 12 and the second ground electrode 15) can be increased. The increase of the capacitance between the radiation electrode 13 and the ground electrode means that the resonant frequency of the radiation electrode is reduced. In other words, the resonant frequency can be restored to its value given before the capacitance is increased, by reducing the size of the radiation electrode 13. That is, this means that the radiation electrode 13, namely, the surface mount circularly polarized wave antenna 10 itself can be miniaturized. Thus, the miniaturization of the surface mount circularly polarized wave antenna 10 can be realized by providing the second ground electrode 15 to increase the capacitance between the radiation electrode 13 and the ground electrode.

Figure 2:
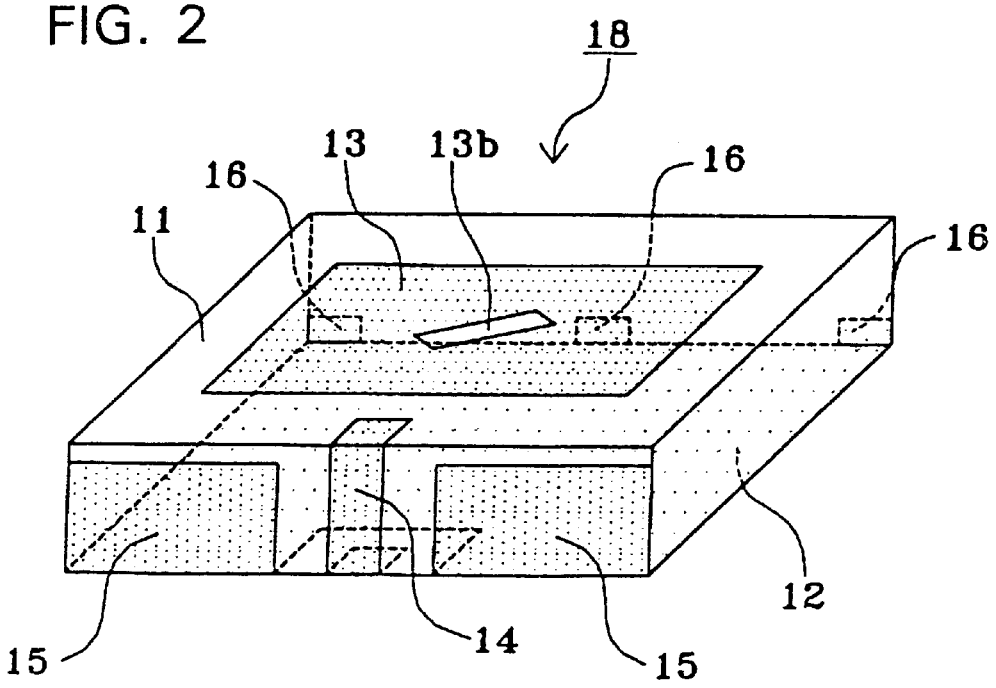
FIG. 2 is a perspective view of a surface mount circularly polarized wave antenna according to a further embodiment of the present invention.

FIG. 2 is a perspective view of a surface mount circularly polarized wave antenna according to another embodiment of the present invention. Like or the same parts in FIGS. 1 and 2 are designated by the same reference numerals. The description of the parts in reference to FIG. 2 will be omitted. A surface mount circularly polarized wave antenna 18 shown in FIG. 2 is provided with a degeneracy separation element 13*b* as a means for separating the degeneracy, positioned along a diagonal line of the radiation electrode 13 and in the center thereof. The degeneracy separation element 13*b* is provided in the shape of a slit which is obtained by removing a rectangular portion from the radiation electrode 13. No degeneracy separation element is provided in a corner of the radiation electrode 13.

As described above, the surface mount circularly polarized wave antenna for which the degeneracy separation element 13*b* having the slit shape as the means for separating the degeneracy is provided inside of the radiation electrode 13 can be operated as a circularly polarized wave antenna, and has the same advantages as the surface mount circularly polarized wave antenna shown in FIG. 1

The degeneracy separation element having the slit shape is not restricted to the rectangular shape. The element may have an elliptical or cross shape.

Figure 3:
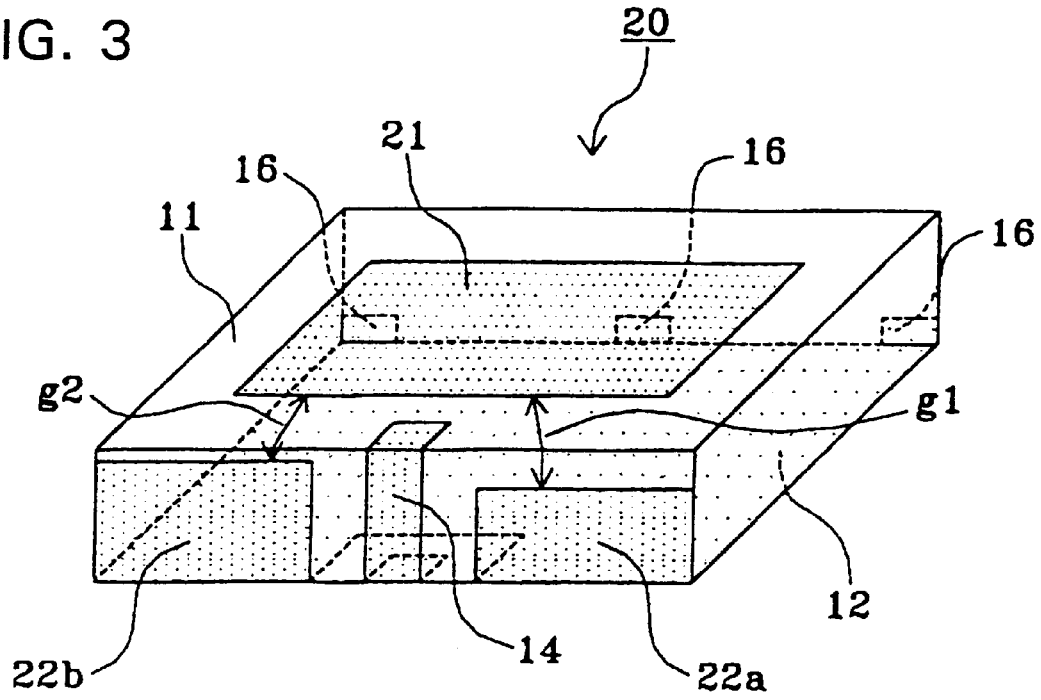
FIG. 3 is a perspective view of a surface mount circularly polarized wave antenna according to a still further embodiment of the present invention.

FIG. 3 is a perspective view of a surface mount circularly polarized wave antenna according to another embodiment of the present invention. Like or the same parts in FIGS. 1 and 3 are designated by the same reference numerals. The description of the parts in reference to FIG. 3 will be omitted. In FIG. 3, the radiation electrode 21 of a surface mount circularly polarized wave antenna 20 is formed in a completely rectangular shape. No particular degeneracy separation element as the means for separating the degeneracy is not provided. Two second ground electrodes 22*a* and 22*b* are disposed substantially on the whole of the side face of the substrate 11 where the feeding electrode 14 is disposed, and in connection to the ground electrode 12 and in insulation from the feeding electrode 14. The second ground electrodes 22*a* and 22*b* are so disposed as to sandwich the feeding electrode 14. The distances g1 and g2 between the second ground electrodes 22*a* and 22*b* and a radiation electrode 21 are made different so that the capacitances between the second ground electrodes 22*a* and 22*b* and the radiation electrode 21 becomes different.

According to the surface mount circularly polarized wave antenna 20 configured as described above, the capacitances between the radiation electrode 21 and the second ground electrodes 22*a* and 22*b* are different, so that two resonant currents become unbalanced, resulting in the separation of the degeneracy. In other words, the difference in capacitance between the second ground electrodes 22*a* and 22*b* and the radiation electrode 21 functions as the means for separating the degeneracy for the radiation electrode 21. Accordingly, in the radiation electrode 21, two resonant currents perpendicular to each other and having a phase difference of 90° are generated. From the two resonant currents, a circularly polarized radio wave is radiated mainly in the normal direction of the radiation electrode 21.

As seen in the above description, this antenna, though the radiation electrode 21 is not provided with the degeneracy separation element, can be operated as a circular polarized wave antenna by making different the capacitances between the second ground electrodes 22*a* and 22*b*, separated sandwiching the feeding electrode 14, and the radiation electrode 21.

Figure 4:
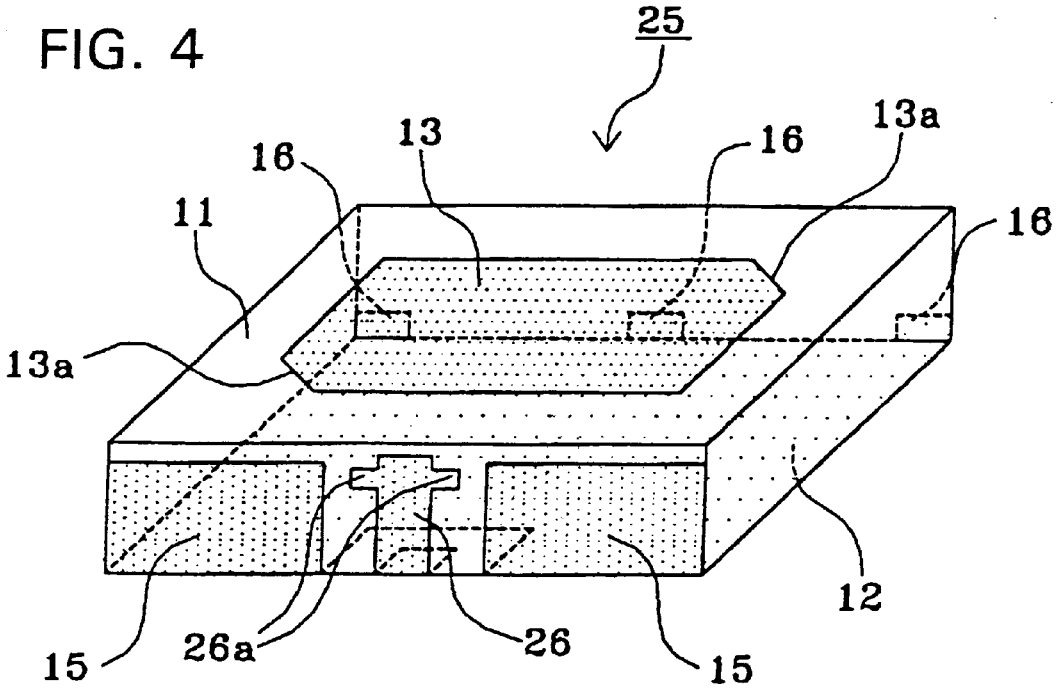
FIG. 4 is a perspective view of a surface mount circularly polarized wave antenna according to another embodiment of the present invention.

FIG. 4 is a perspective view of a surface mount circularly polarized wave antenna according to a still further embodiment of the present invention. Like or the same parts in FIGS. 1 and 4 are designated by the same reference numerals. The description of the parts in reference to FIG. 4 will be omitted. In FIG. 4, the feeding electrode 26 of a surface mount circularly polarized wave antenna 25 has two protuberances 26*a* on one edge side thereof, presenting a substantially cross shape.

According to the surface mount circularly polarized wave antenna 25 of the present invention configured as described above, the capacitance between the one edge of the feeding electrode 26 and the one side of the radiation electrode 13 can be increased. Ordinarily, if the ground electrode (for example, the second ground electrode 15) is positioned nearer to the radiation electrode 13, the capacitance between the radiation electrode 13 and the ground electrode becomes very high, making it difficult to match input to the surface mount circularly polarized wave antenna 25. However, the matching can be achieved by increasing the capacitance between the feeding electrode 26 and the radiation electrode 13 correspondingly to the above-described increased capacitance. This is more effective in reducing dispersions in the capacitance caused by variations in printing of the respective electrodes, as compared with a method of increasing the capacitance by providing the feeding electrode 26 still nearer to the radiation electrode 13. As a result, dispersions in the characteristics of the surface mount circularly polarized wave antenna 25 can be reduced. Furthermore, the capacitance between the feeding electrode 26 and the radiation electrode 13 can be increased by providing the protuberances 26*a* for the feeding electrode 26 in the side face of the substrate 11 where the feeding electrode 26 is formed, without the feeding electrode 26 so provided to be turned onto (extend on) the second main face of the substrate 11. This makes it easy to form the feeding electrode 26.

Figure 5:
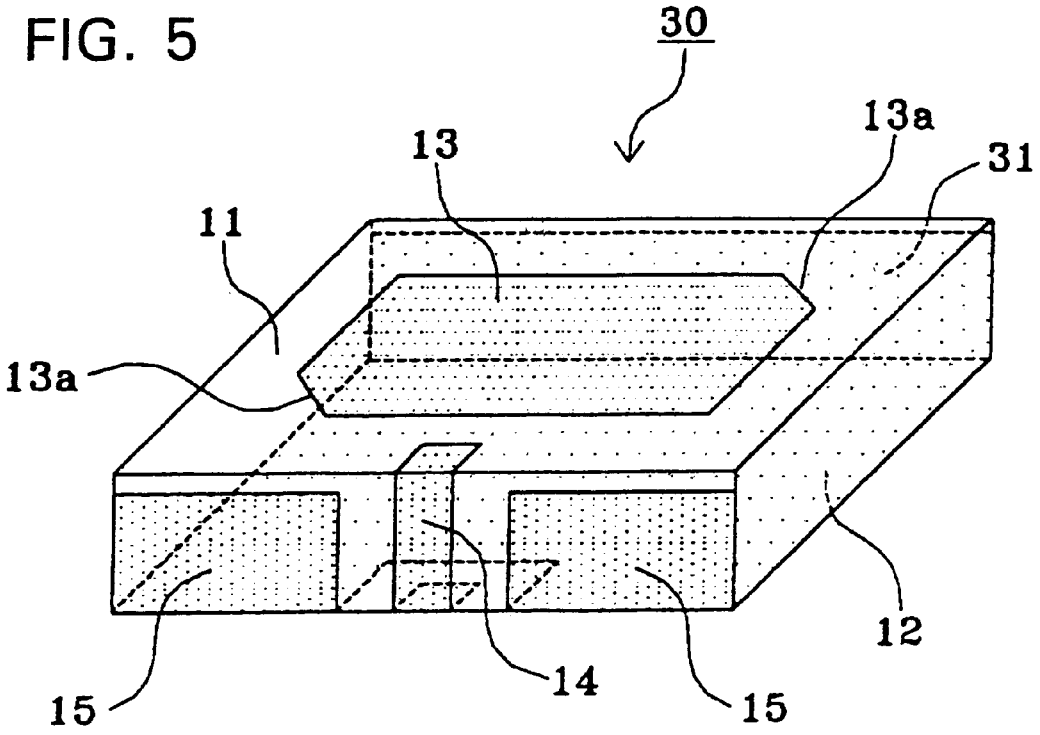
FIG. 5 is a perspective view of a surface mount circularly polarized wave antenna according to a further embodiment of the present invention.

FIG. 5 is a perspective view of a surface mount circularly polarized wave antenna according to another embodiment of the present invention. Like or the same parts in FIGS. 1 and 5 are designated by the same reference numerals. The description of the parts in reference to FIG. 5 will be omitted. In a surface mount circularly polarized wave antenna 30 shown in FIG. 5, a third ground electrode 31 is disposed substantially on the whole of the side face of the substrate 11 opposite to the side face thereof where the feeding electrode 13 is disposed, and in connection to the first ground electrode 12.

According to the surface mount circularly polarized wave antenna 30 configured as described above, the ground electrode is positioned nearer to the radiation electrode 13. Therefore, the capacitance between the radiation electrode 13 and the ground electrode (the first ground electrode 12, the second ground electrode 15, and the third ground electrode 31) can be increased. Accordingly, the surface mount circularly polarized wave antenna 30 can be further miniaturized. In addition, the directivity of radiation of the surface mount circularly polarized wave antenna 30 can be controlled by making different the heights of the second ground electrode 15 and the third ground electrode 31 which are provided on the two opposite side faces of the substrate 11.

Figure 6:
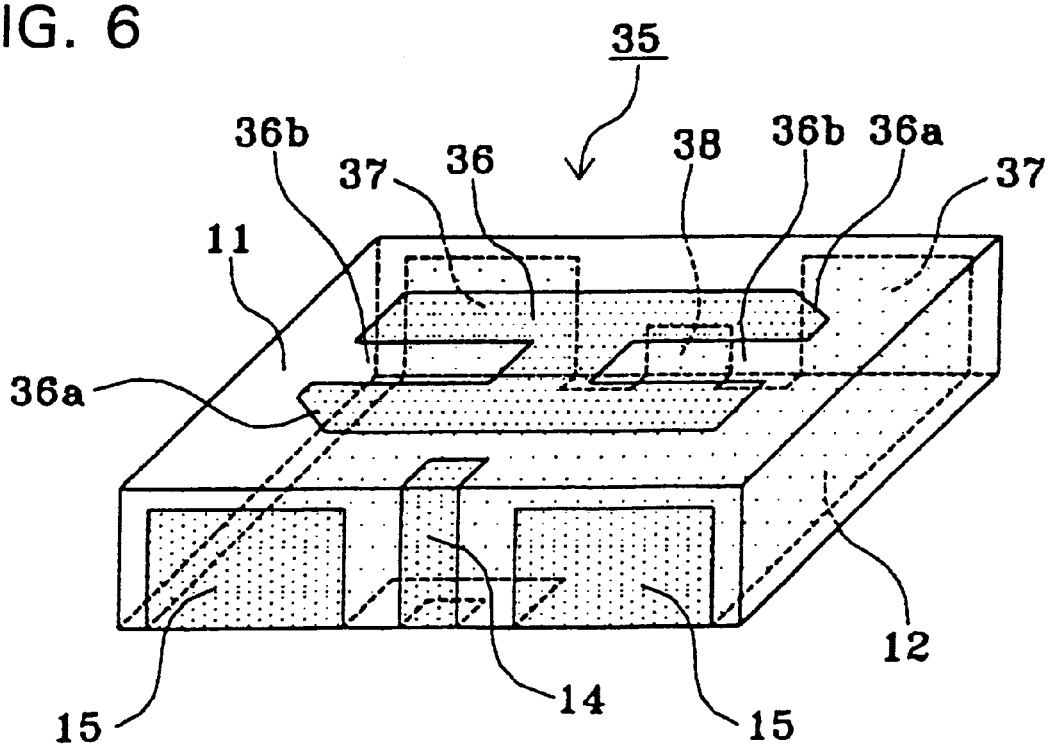
FIG. 6 is a perspective view of a surface mount circularly polarized wave antenna according to a still further embodiment of the present invention.

FIG. 6 is a perspective view of a surface mount circularly polarized wave antenna according to a further embodiment of the present invention. Like or the same parts in FIGS. 1 and 6 are designated by the same reference numerals. The description of the parts in reference to FIG. 6 will be omitted. In a surface mount circularly polarized wave antenna 35 shown in FIG. 6, a radiation electrode 36 is provided with degeneracy separation elements 36*a* in two corners of the radiation electrode 36. Furthermore, the radiation electrode 36 has two slits 36*b* so disposed as to be elongated toward the center of the radiation electrode 36 from the respective middles of the opposite sides thereof which are connected directly to the side thereof which is positioned near to the one edge of the feeding electrode 14. Furthermore, in the side face of the substrate 11 opposite to the side face thereof where the feeding electrode 14 is disposed, two third ground electrodes 37 are disposed opposite to the second ground electrodes 15 and in connection to the first ground electrode 12. A fixing electrode 38 for soldering is disposed between the two third ground electrodes 37 and in connection to the first ground electrode 12.

According to the surface mount circularly polarized wave antenna 35 configured as described above, the path of a magnetic flux in the radiation electrode 36 is prolonged due to the provided slits 36*b*. The prolonged path has the function of reducing the resonant frequency of the radiation electrode 36 similarly to the increase of the capacitance between the radiation electrode 36 and the ground electrode. As a result, the radiation electrode 36, that is, the surface mount circularly polarized wave antenna 35 can be miniaturized.

Figure 7:
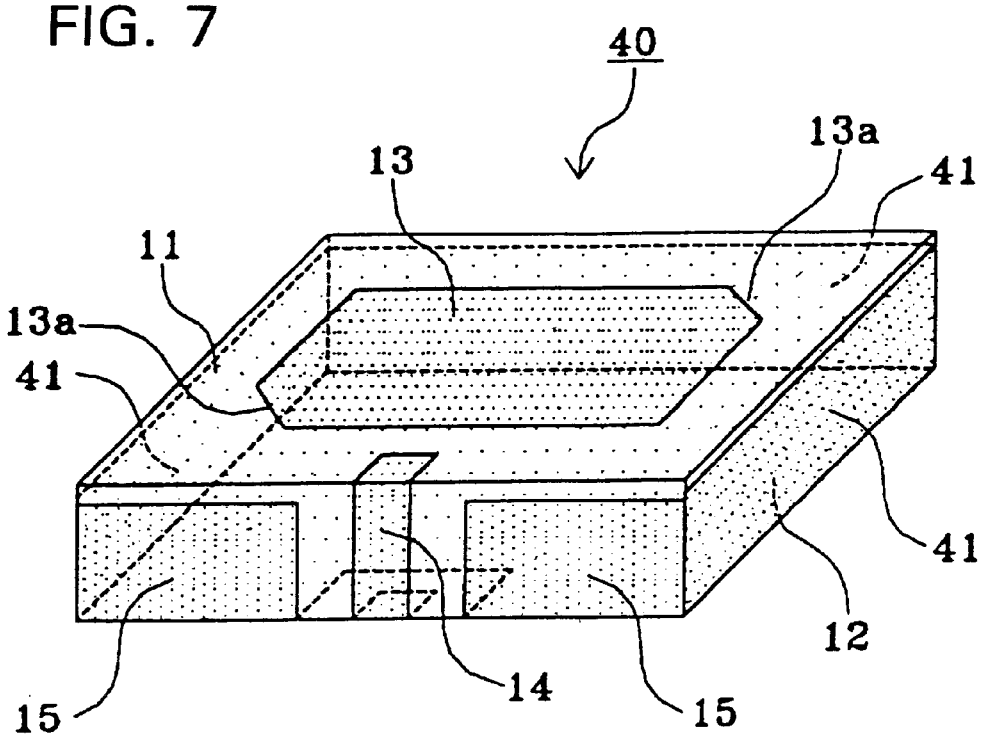
FIG. 7 is a perspective view of a surface mount circularly polarized wave antenna according to another embodiment of the present invention.

FIG. 7 is a perspective view of a surface mount circularly polarized wave antenna according to an additional embodiment of the present invention. Like or the same parts in FIGS. 1 and 7 are designated by the same reference numerals. The description of the parts in reference to FIG. 7 will be omitted. In a surface mount polarized wave antenna 40 shown in FIG. 7, a third ground electrode 41 is formed substantially on the whole of the three side faces of the substrate 11 excluding the side face thereof where the feeding electrode 14 is disposed, and in connection to the first ground electrode 12.

According to the surface mount circularly polarized wave antenna 40 configured as described above, the ground electrode is positioned nearer to the radiation electrode 13. Thus, the capacitance between the radiation electrode 13 and the ground electrode (the first ground electrode 12, the second ground electrode 15, and the third ground electrode 41) can be increased. Accordingly, the further miniaturization of the surface mount circularly polarized wave antenna 40 can be achieved.

Figure 8:
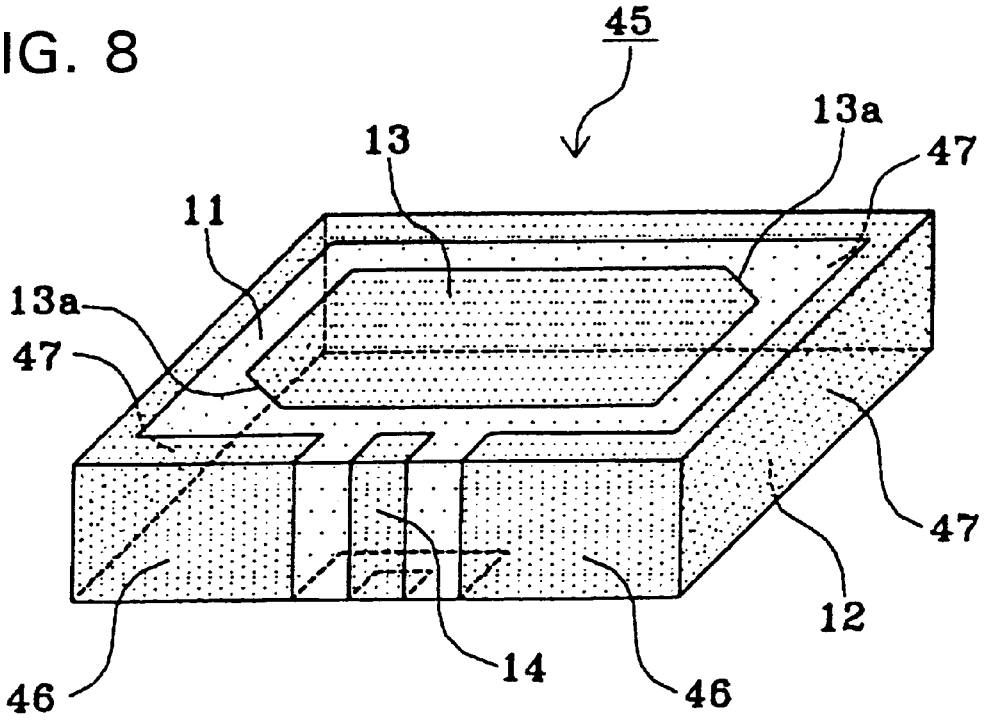
FIG. 8 is a perspective view of a surface mount circularly polarized wave antenna according to a further embodiment of the present invention.

FIG. 8 is a perspective view of a surface mount circularly polarized wave antenna according to another embodiment of the present invention. Like or the same parts in FIGS. 7 and 8 are designated by the same reference numerals. The description of the parts in reference to FIG. 8 will be omitted. In a surface mount polarized wave antenna 45 shown in FIG. 8, a second ground electrode 46 is disposed substantially on the whole of the side face of the substrate 11 where the feeding electrode 14 is disposed, and in connection to the ground electrode 12 and in insulation from the feeding electrode 14. Furthermore, a third ground electrode 47 is disposed on the whole of the other three side faces, in connection to the first ground electrode 12. The second ground electrode 46 and the third electrode 47 are partially turned onto (extends onto) the second main face of the substrate 11, in insulation from the radiation electrode 13.

According to the surface mount circularly polarized wave antenna 45 configured as described above, the ground electrode is positioned still nearer to the radiation electrode 13. Thus, the capacitance between the radiation electrode 13 and the ground electrode (the first ground electrode 12, the second ground electrode 46, and the third ground electrode 47) can be increased. Accordingly, the further miniaturization of the surface mount circularly polarized wave antenna 45 can be achieved.

In the respective above-described embodiments, the substrate of the surface mount circularly polarized wave antenna is made of a dielectric such as a ceramic, resin, and the like. However, it may be made of a magnetic material.

Figure 9:
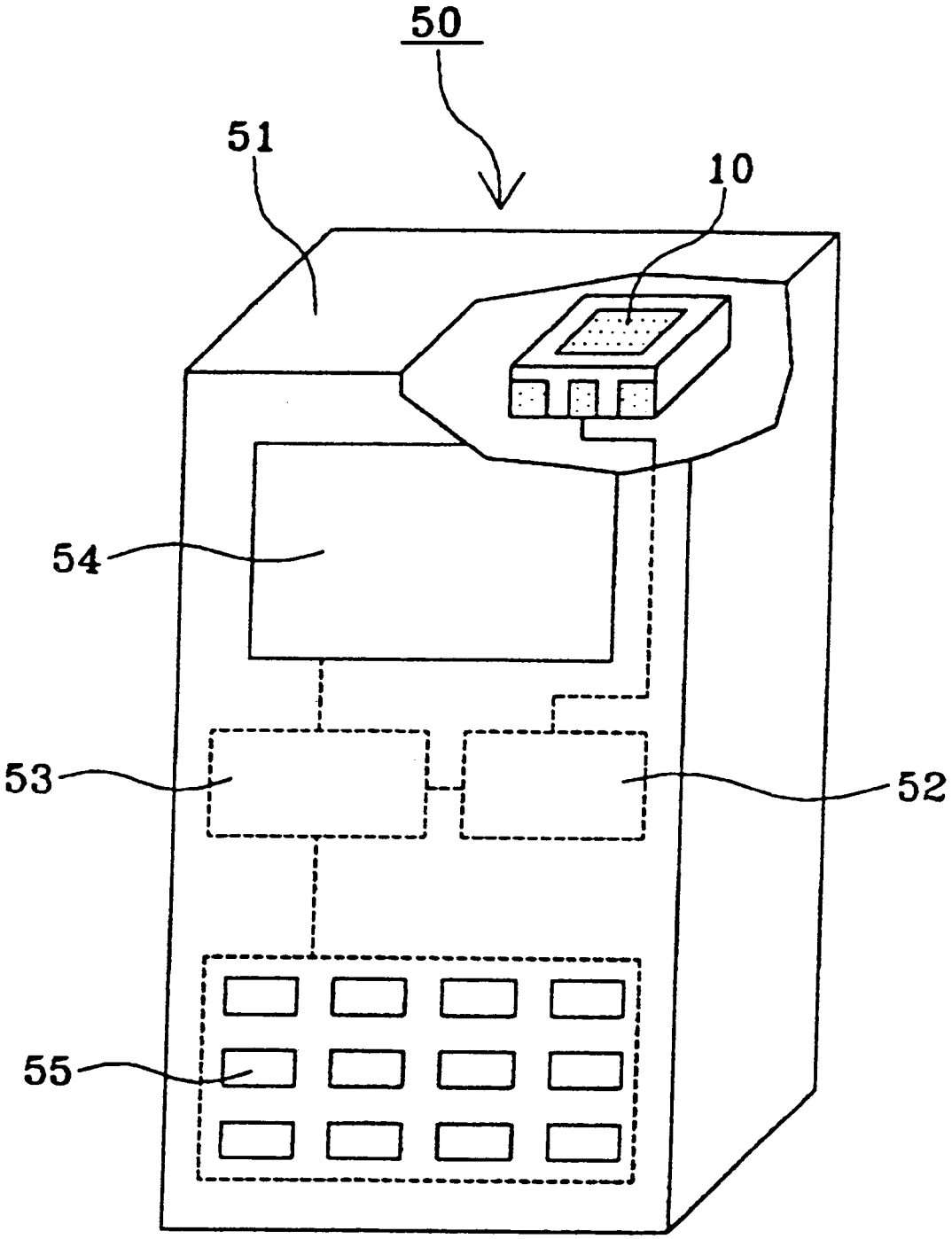
FIG. 9 is a block diagram of a communication apparatus according to an embodiment of the present invention.
Figure 10:
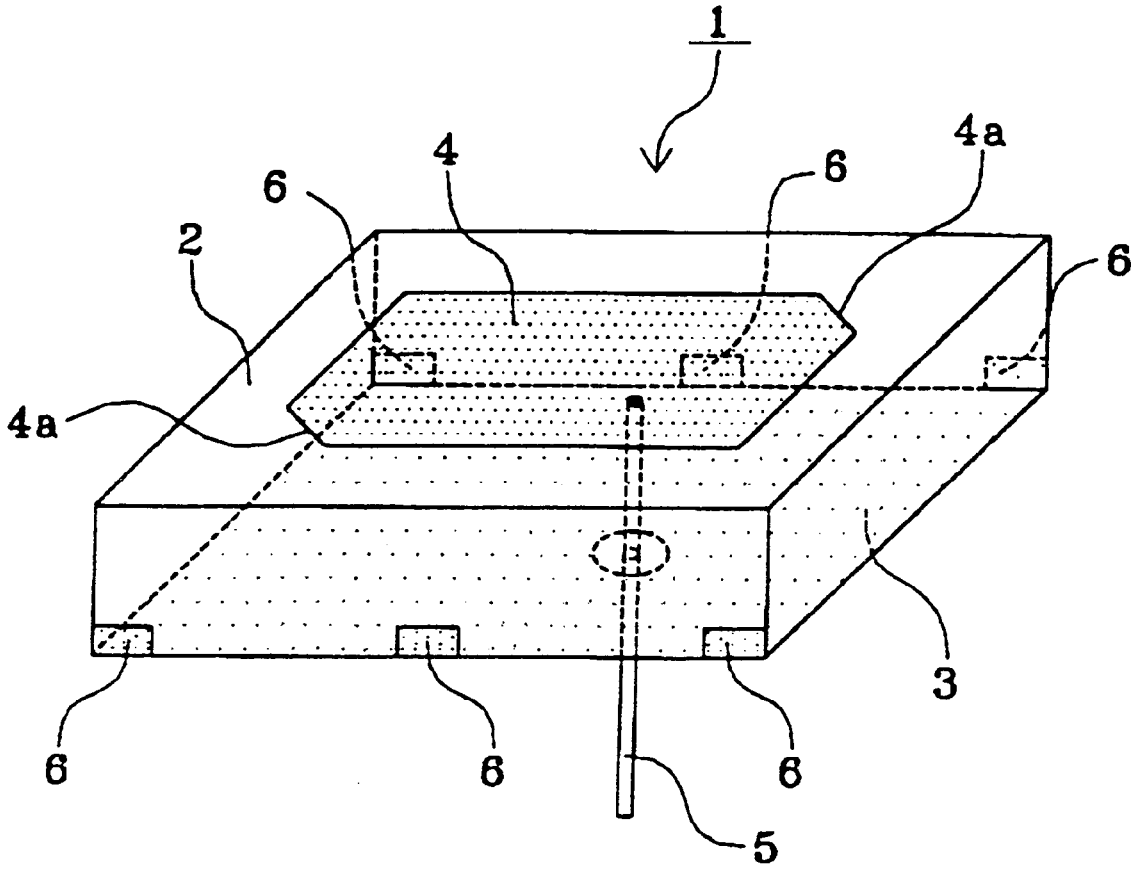
FIG. 10 PRIOR ART
FIG. 10 is a perspective view of a conventional circularly polarized wave antenna.

FIG. 9 illustrates the configuration of a portable navigation system as one example of a communication apparatus having the surface mount circularly polarized wave antenna according to the present invention.

In FIG. 9, a communication apparatus 50 comprises a case 51, the surface mount circularly polarized wave antenna 10 of the present invention, a receiving section 52 connected to the surface mount circularly polarized wave antenna 10, a signal processing section 53 connected to the receiving section 52, and a display 54 and an interface section 55 connected to the signal processing section 53, respectively. The surface mount circularly polarized wave antenna 10 receives circularly polarized radio waves transmitted from plural GPS satellites. The receiving section 52 picks up various signals from the radio waves. The signal processing section 53, based on the received signals, determines the present location (longitude, latitude, and altitude) of the communication apparatus 50 itself, namely, that of a person carrying the communication apparatus 50, and displays the location on the display 54 in cooperation with the interface section 55 such as a key board and the like.

According to the communication apparatus 50 configured by using the surface mount circularly polarized wave antenna 10 of the invention as described above, the communication apparatus 50 itself can be miniaturized and made easy to be carried by making compact the surface mount circularly polarized wave antenna 10.

In the communication apparatus 50, the surface mount circularly polarized wave antenna 10 shown in FIG. 1 is employed. However, similar advantages can be obtained if any of the surface mount circularly polarized wave antennas 20, 25, 30, 35, 40, and 45 is employed.

Although the invention has been described particularly in its preferred embodiments, it is understood to those skilled in the art that various changes and modifications in shape and size may be made in the invention without departing from the spirit and scope thereof.

What is claimed is:

1. A surface mount circularly polarized wave antenna comprising a substrate comprising an insulating material and having a first main face, a second main face, and at least one side face extending between said first main face and said second main face;

a first ground electrode disposed on said first main face of said substrate;

a radiation electrode having a substantially rectangular shape and disposed on said second main face;

a feeding electrode disposed on said one side face of the substrate extending from the first main face of said substrate, and toward the second main face, one edge of said feeding electrode being positioned near to one side of said radiating electrode;

a second ground electrode disposed on the same one side face of said substrate where said feeding electrode is disposed, and being electrically conductively isolated from said feeding electrode and electrically conductively connected to said first ground electrode; and a degeneracy separation element provided in relation to said radiation electrode for causing radiation of a circularly polarized wave from the radiation electrode.

2. The surface mount circularly polarized wave antenna of claim 1, wherein the degeneracy separation element comprises a corner of said radiation electrode being removed along an angled line at the corner.

3. The surface mount circularly polarized wave antenna of claim 1, wherein two second ground electrodes are so disposed on either side of said feeding electrode and a capacitance between one of said second ground electrodes and said radiation electrode is made different from a capacitance between the other of said second ground electrodes and said radiation electrode, whereby the second ground electrodes comprises the degeneracy separation element.

4. The surface mount circularly polarized wave antenna of claim 1, wherein said feeding electrode has at least one protuberance.

5. The surface mount circularly polarized wave antenna of claim 1, wherein a third ground electrode is disposed substantially on the whole of at least one side face of said substrate excluding the side face thereof where said feeding electrode is disposed, and being electrically conductively connected to said first ground electrode.

6. The surface mount circularly polarized wave antenna of claim 5, wherein a part of at least one of the second and third ground electrodes are so disposed as to be turned onto said second main face of said substrate.

7. A communication apparatus having a surface mount circularly polarized wave antenna, wherein said surface mount circularly polarized wave antenna comprises a substrate comprising an insulating material and having a first main face, a second main face, and at least one side face extending between said first main face and said second main face;

a first ground electrode disposed on said first main face of said substrate;

a radiation electrode having a substantially rectangular shape and disposed on said second main face;

a feeding electrode disposed on said one side face of the substrate extending from the first main face of said substrate, and toward the second main face, one edge of said feeding electrode being positioned near to one side of said radiation electrode;

a second ground electrode disposed on the side face of said substrate where said feeding electrode is disposed, and being electrically conductively isolated from said feeding electrode and electrically conductively connected to said first ground electrode; and a degeneracy separation element provided in relation to said radiation electrode for causing radiation of a circularly polarized wave from the radiation electrode.

8. The communication apparatus of claim 7, wherein the degeneracy separation element comprises a corner of said radiation electrode being removed along an angled line at the corner.

9. The communication apparatus of claim 7, wherein two second ground electrodes are so disposed on either side of said feeding electrode and a capacitance between one of said second ground electrodes and said radiation electrode is made different from a capacitance between the other of said second ground electrodes and said radiation electrode, whereby the second ground electrodes comprise the degeneracy separation element.

10. The communication apparatus of claim 7, wherein said feeding electrode has at least one protuberance.

11. The communication apparatus of claim 7, wherein a third ground electrode is disposed substantially on the whole of at least one side face of said substrate excluding the side face thereof where said feeding electrode is disposed, and being electrically conductively connected to said first ground electrode.

12. The communication apparatus of claim 11, wherein a part of at least one of the second and third ground electrodes are so disposed as to be turned onto said second main face of said substrate.

* * * * *